US009161664B2

(12) United States Patent
Zeng

(10) Patent No.: US 9,161,664 B2
(45) Date of Patent: Oct. 20, 2015

(54) SHOWER ROD WITH SPRING ADJUSTMENT

(76) Inventor: Qing Hai Zeng, Houston, TX (US)

( * ) Notice: Subject to any disclaimer, the term of this patent is extended or adjusted under 35 U.S.C. 154(b) by 905 days.

(21) Appl. No.: 13/367,301

(22) Filed: Feb. 6, 2012

(65) Prior Publication Data

US 2013/0198949 A1 Aug. 8, 2013

(51) Int. Cl.
*A47K 3/00* (2006.01)
*A47K 3/38* (2006.01)

(52) U.S. Cl.
CPC ..... *A47K 3/38* (2013.01); *Y10T 29/49826* (2015.01)

(58) Field of Classification Search
USPC ..... 4/610
See application file for complete search history.

(56) References Cited

U.S. PATENT DOCUMENTS

| | | | | |
|---|---|---|---|---|
| 2,519,996 | A * | 8/1950 | Blake | 211/105.6 |
| 3,956,784 | A * | 5/1976 | Vargas | 135/96 |
| 4,209,099 | A * | 6/1980 | Wickes | 211/182 |
| 5,894,610 | A * | 4/1999 | Winter | 4/558 |
| 6,845,955 | B1 * | 1/2005 | Hsu | 248/200.1 |
| 7,076,815 | B2 | 7/2006 | Orpilla | |
| D636,660 | S | 4/2011 | O'Connell | |
| 7,926,127 | B2 | 4/2011 | Barrese | |
| 7,987,534 | B2 | 8/2011 | Lin | |
| 8,015,633 | B2 | 9/2011 | Ho | |
| 8,069,507 | B2 | 12/2011 | Didehvar | |
| 8,505,129 | B2 * | 8/2013 | Parker et al. | 4/610 |
| 2004/0178310 | A1 * | 9/2004 | Marion | 248/251 |
| 2013/0047331 | A1 * | 2/2013 | Parker et al. | 4/610 |

* cited by examiner

*Primary Examiner* — Huyen Le
(74) *Attorney, Agent, or Firm* — Andrew W. Chu; Craft Chu PLLC

(57) ABSTRACT

An embodiment of the present invention is a shower rod assembly including an outer tube, a spring chamber, being housed in the attachment end of the outer tube, and inner tube with an attachment end inserted within said outer tube, and a bracket device at the opposite ends of the outer tube and inner tube for installation in an enclosure. The spring chamber has a fixed blocker in a locked position within the outer tube, a compression spring, and a mobile blocker with a removable locking pin. When the locking pin is removed, the compression spring extends to lock the outer tube and inner tube in position at a set length within the enclosure. Each bracket device has a base body with ridges, a casing with an inner core, a lock on the side of the casing and a mount.

19 Claims, 3 Drawing Sheets

10
14
16
20
32
34
38
42
44
48
52
54
56
58

SHOWER ROD WITH SPRING ADJUSTMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a generally curved shower curtain rod assembly for installation in a bathtub/shower enclosure.

2. Description of Related Art Including Information Disclosed Under 37 CFR 1.97 and 37 CFR 1.98.

Typical bathrooms include a bathtub with a shower nozzle mounted on a wall above the tub, so that the bathtub functions as a shower as well as a bathtub. Other enclosures can also function as a shower, as long as there are walls on three sides of the bathtub/shower enclosure. The back wall has two opposing walls extending from both ends, so that an open side of the bathtub/shower enclosure remains accessible for the user. The shower nozzle may be mounted on either of the back wall or an opposing wall.

The open side requires a covering so that water spray from the shower nozzle stays within the bathtub/shower enclosure. It is well known to use a shower curtain suspended from a shower rod for this purpose. This prior art shower rod attaches to the two opposing walls across the open side. The prior art shower rod is a straight bar with variable or fixed length with ends attached to the opposing walls. Various attachments means have been used for the mounting of the prior art shower rod, including drilling holes, adhesives, and friction fit devices to lock the shower rod in place and to sustain the weight of a shower curtain.

Bathtub/shower enclosures have various sizes and dimensions. The three walls can have different surfaces and different lengths. Generally, the opposing walls are parallel to each other to allow for a shower rod to be mounted across the opposing walls, regardless of the length between the two opposing walls. Shower rods have adapted to fit in any size enclosure. For example, shower rods have telescoping lengths, special brackets, extension pieces, and curvatures. The variable length fits the different size enclosures; brackets allow attachment to the opposing walls in different situations; and curvature of the shower rod creates extra space in the enclosure and addresses curved bathtubs.

The curved shower rod presents special problems. First, variable length is complicated by the curvature. The curved rod increases in length and depth. As the curved rod lengthens, the arc of curvature increases, which changes the angles at the end of the shower rod for attachment and affects the stability of the shower rod. Special mounting brackets have evolved to account for these new angles and curvature as the length of the curved shower rod varies, such as pivots, ball-socket, and hinged brackets. Second, the telescoping tubes are not easily adjustable. The twisting action to extend the straight rod differs from the twisting action of a curved rod. The curved rod is more unstable with axial movement, unlike a straight shower rod. Additionally, it is virtually impossible to friction fit a curved rod in the enclosure because the ends of the rod do not remain flush to the opposing walls. Any adhesive or longitudinal pressure through the length of the shower rod pulls or twists the bracket from the opposing wall. The force does not remain orthogonal to the surface of the wall, resulting in distortion and weakened attachment to the opposing walls of the enclosure.

It is an object of the present invention to provide an embodiment of the shower rod assembly with curvature and adjustable length.

It is another object of the present invention to provide an embodiment of the shower rod assembly with curvature and adjustable length that can be easily and quickly adjusted.

It is still another object of the present invention to provide an embodiment of the shower rod assembly with curvature and adjustable length with a bracket for friction fit attachment to the enclosure.

It is still another object of the present invention to provide an embodiment of the shower rod assembly with curvature and adjustable length with a bracket for adhesive attachment to the enclosure.

It is yet another object of the present invention to provide an embodiment of the shower rod assembly with curvature and adjustable length with improved attachment strength to the enclosure.

It is yet another object of the present invention to provide an embodiment of the shower rod assembly with curvature and adjustable length which can maintain position of the curvature relative to the enclosure.

It is an object of the present invention to provide an embodiment of the shower rod assembly with curvature and adjustable length with quick and easy length adjustment for installation.

It is an object of the present invention to provide an embodiment of the shower rod assembly with curvature and adjustable length with installation by spring adjustment.

It is an object of the present invention to provide an embodiment of the shower rod assembly with curvature and adjustable length with installation by twisting for length adjustment.

These and other objectives and advantages of the present invention will become apparent from a reading of the attached specifications and appended claims.

SUMMARY OF THE INVENTION

An embodiment of the present invention is a shower rod assembly comprising an outer tube, an inner tube, a spring chamber housed in the attachment end of the outer tube, and a bracket device. The inner tube is inserted within said outer tube so as to adjust the length of the outer and inner tubes to fit an enclosure for a shower. There is a bracket device at the opposite ends of the outer tube and inner tube for installation in the enclosure.

The spring chamber has a fixed blocker in a locked position within the outer tube, a compression spring, and a mobile blocker with a removable locking pin. When the locking pin is positioned in the mobile blocker, the spring is compressed, and the inner tube can move within the outer tube for variable lengths. At a set length, the outer tube and inner tube fit within the enclosure. When the locking pin is removed, the compression spring extends to lock the outer tube and inner tube in position at the set length within the enclosure.

Each bracket device has a base body with ridges, a casing with an inner core, a lock on the side of the casing and a mount. Each tube has a respective bracket device to attach to a respective wall of the enclosure for installation. Each mounting end of the outer tube and the inner tube engages a respective casing and inner core of a respective bracket device. Because each mounting end is generally hollow, the respective inner core fits inside the tube and a respective casing fits around the outside of the tube. The lock holds the tube relative to the bracket to maintain position and rotation of each tube.

DETAILED DESCRIPTION OF THE DRAWINGS

Figures 1A, 1B, 1C:
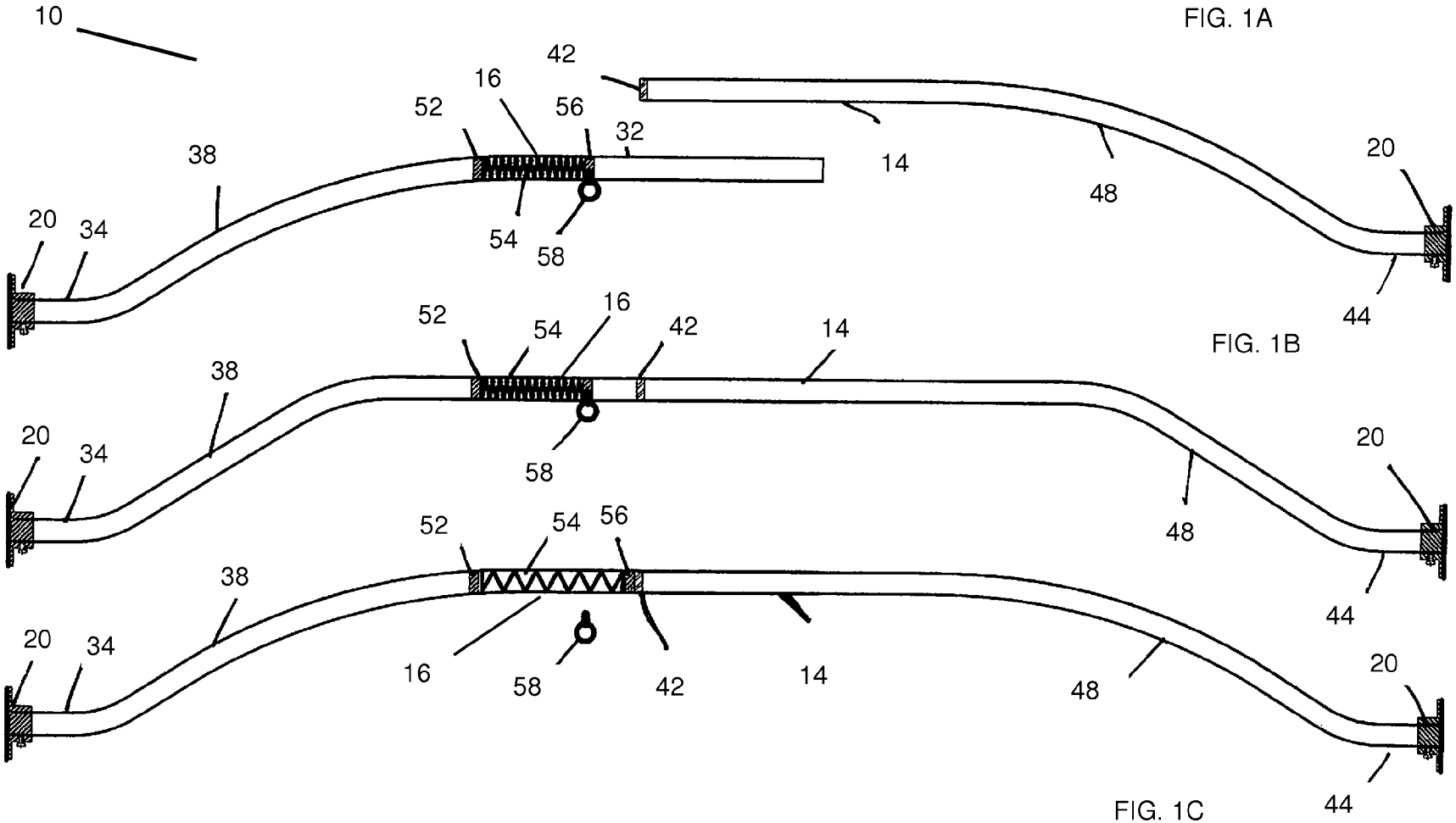
FIG. 1A is an exploded schematic view of an embodiment of the shower rod assembly of the present invention.
FIG. 1B is another schematic view of the embodiment of FIG. 1A, showing an open position.
FIG. 1C is another schematic view of the embodiment of FIG. 1A, showing a locked position.

FIGS. 1A, 1B, 1C, 2 and 3 show an embodiment of the shower rod assembly 10 of the present invention. The shower rod assembly 10 forms a curved curtain rod with variable length for installation in a bathtub/shower enclosure of any size. FIG. 1A shows the shower rod assembly 10 including an outer tube 12, an inner tube 14, a spring chamber 16, and a bracket means 20. The length of the shower rod assembly 10 measures from one end of the outer tube 12 to the opposite end of the inner tube 14, with respective bracket means 20 capping these ends of the outer and inner tubes 12, 14. The bracket means 20 contact the walls of the bathtub/shower enclosure for installation. FIGS. 1B and 1C disclose the overall length of the shower rod assembly 10 as spanning from the back of one bracket means 20, the outer tube 12, the inner tube 14, and the back of another bracket means 20.

As shown in FIGS. 1A-1C and FIGS. 2-3, the outer tube 12 is generally hollow and has an attachment end 32 and a mounting end 34. The inner tube 14 is also generally hollow and has a mounting end 44 and an attachment end 42. The attachment end 42 of the inner tube 14 has a diameter smaller than the attachment end 32 of the outer tube 12. Thus, the attachment end 42 of the inner tube 14 is insertable within the attachment end 32 of the outer tube 12. This telescoping effect allows the overall length of the assembly 10 to be adjusted to fit an enclosure of any size. The inner tube 14 can slide within the attachment end 32 of the outer tube 12 for length adjustment during installation.

To form the curvature, the outer tube 12 further comprises a first arcuate portion 38 between the mounting end 34 and the attachment end 32; and the inner tube 14 further comprises a second arcuate portion 48 between the mounting end 44 and the attachment end 42. In one embodiment, these mounting ends 34, 44 and the attachment ends 32, 42 are linear, such that these ends 32, 34, 42, 44, can be aligned and parallel. In alternate embodiments, the attachment ends 32, 42 may not be linear, such that the spring chamber 16 can extend through curved portions of the tubes 12, 14. For example, the attachment ends 32, 34 may be continuously curved with the arcuate portions, while the spring chamber 16 extends within this curved volume.

Longitudinal pressure can still be exerted through the assembly 10 due to the partial linear and straight portions. The arcuate portions 38, 48 still provide the benefit of a curved shower rod with the extra volume formed in the enclosure. The first arcuate portion 38 and the second arcuate portion 48 have identical curvature in FIGS. 1A-1C, so that the overall curvature of the assembly 10 is consistent. Alternatively, the curvature due to the arcuate portions 38, 48 and possibly the attachment ends 32, 34 may also form the curved portion, while the mounting ends 42, 44 form the linear and straight portions of the assembly 10.

Figure 2:
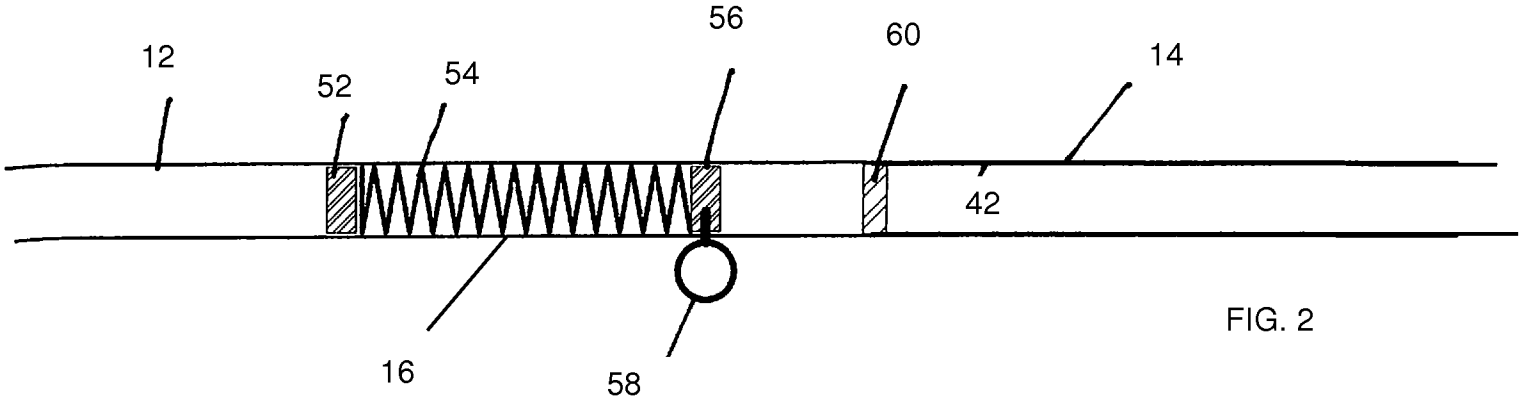
FIG. 2 is an enlarged sectional view of an embodiment of the shower rod assembly of the present invention, showing an open position.
Figure 3:
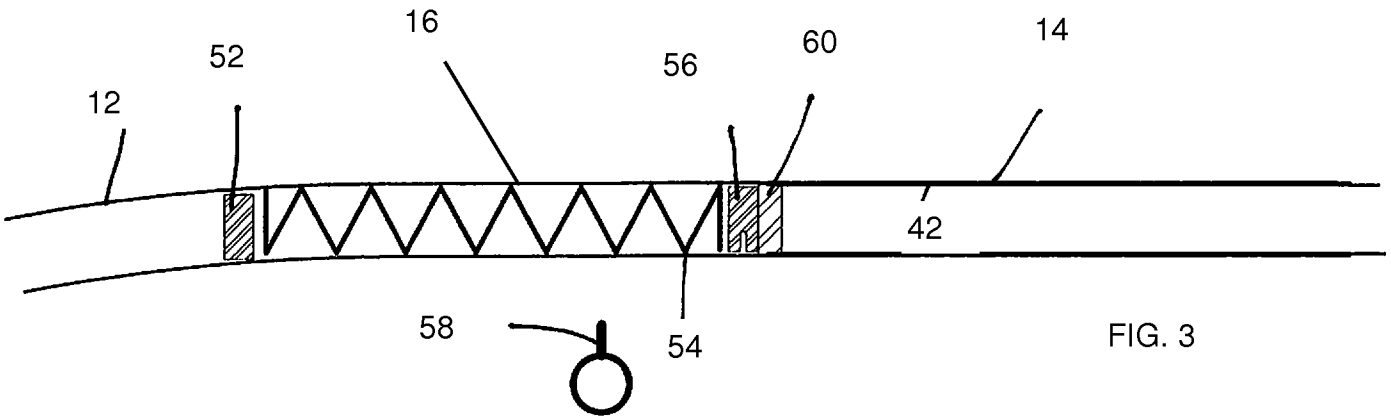
FIG. 3 is an enlarged sectional view of the embodiment of FIG. 2, showing a locked position.

FIGS. 2 and 3 show an enlarged view of the embodiment of the present invention with the spring chamber 16. The spring chamber 16 is housed in the attachment end 32 of the outer tube 12. The spring chamber 16 is set back from the tip to allow the inner tube 14 to slide within the attachment end 32 in order to adjust the length of the assembly for installation. The spring chamber 16 comprises a fixed blocker 52, a compression spring 54, and a mobile blocker 56. The fixed blocker 52 is maintained in a stable and locked position within the outer tube 12, such that the fixed blocker 52 resists movement along the axis of the outer tube 12. The fixed blocker 52 can be friction fit within the outer tube 12 or even welded. Alternatively, the fixed blocker 52 is positioned adjacent the first arcuate portion 38 of the outer tube 12 as shown in FIG. 3. The shape of the fixed blocker 52 and the slight bend of the first arcuate portion 38 maintain the position of the fixed blocker 52 in the outer tube 12.

The compression spring 54 has one end in contact with the fixed blocker 52 and an opposite end in contact with the mobile blocker 56. The compression spring 54 has a compressed state and an extended state and remains in contact with the fixed blocker 52 and mobile blocker 56 in either state. The mobile blocker 56 has a removable locking pin 58 and is positioned on the opposite end of the compression spring 54 from the fixed blocker 52. The mobile blocker 56 engages the locking pin 58, when the compression spring 54 is in a compressed state. The locking pin 58 maintains the position of the mobile blocker 56 within the outer tube 12 and resists the force of the compression spring 54 to extend. Releasing the locking pin 58 from the mobile blocker 56 enables the compression spring 54 to extend along the length of the outer tube 12, pushing the mobile blocker 56 towards the tip of the attachment end 32. The spring chamber 16 remains extendable in either linear or curved attachment ends 32, 34.

Figure 4:
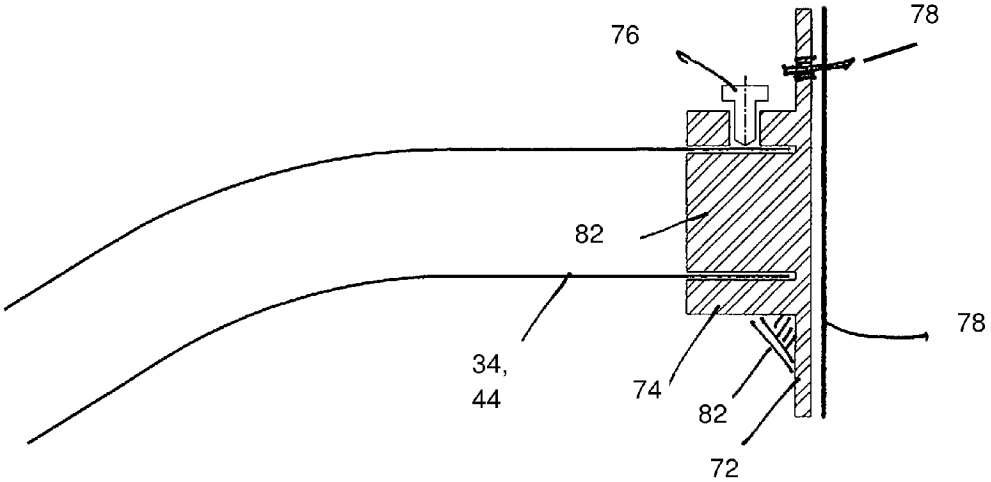
FIG. 4 is a perspective view of the bracket of an embodiment of the shower rod assembly of the present invention.
Figure 5:
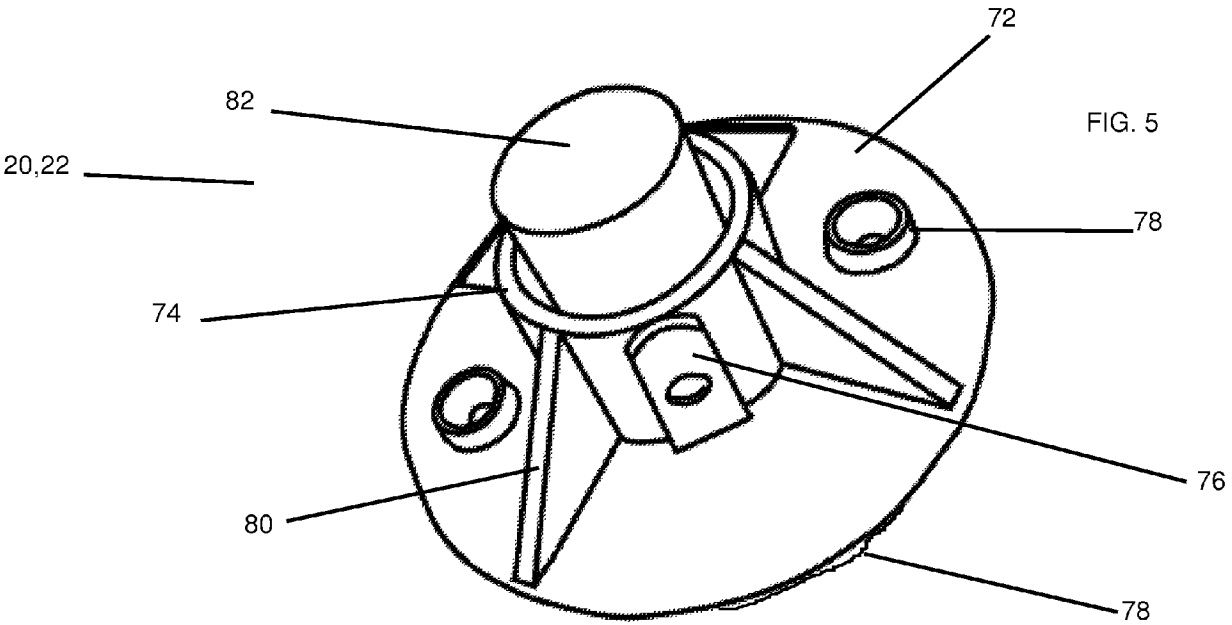
FIG. 5 is a cross-sectional view of the bracket of FIG. 4.

FIGS. 4 and 5 show the bracket means 20 engaging the mounting end 34 of the outer tube 12 and the mounting end 44 of the inner tube 14 for installation. Each bracket means 20 are generally identical. Although the diameter of the attachment end 42 of the inner tube 14 is smaller than the diameter of the attachment end 32 of the outer tube 12, the mounting ends 34, 44 may have the same diameter or about the same diameter. The bracket means 20 should remain compatible with both mounting ends 34, 44.

The bracket means 20 engages the mounting end 34 of the outer tube 12, and a second bracket means 20 engages the mounting end 44 of the inner tube 14 for installation. Each bracket means 20 is virtually identical, or at least compatible with both mounting ends 34, 44 of any diameter. The bracket means 20 are placed on opposite sides of the assembly 10, facing each other. The back sides of the bracket means 20 contact the walls of the enclosure for fixing the position of the assembly 10 in the enclosure.

Each bracket means 20 comprises a base body 72 with ridges 80, a casing 74, a locking means 76, and a mounting means 78. The base body 72 is generally round and formed of a strong and resilient material to handle the weight of the tubes 12, 14 and a shower curtain. The ridges 80 provide extra strength and durability. The mounting means 78 can be placed on the back of the base body 72 for contacting the wall of the enclosure for installation. Any known prior art mounting can be used at the mounting means 78, such as an adhesive or screws and screw holes. The adhesive type mounting means uses friction to maintain the position on the wall of the enclosure. Although drilling into dry wall or plaster for mounting screws is another mounting means.

The casing 74 has an inner core 82, being centered on the base body 72. The locking means 76 is placed on a side of the casing 74. Each mounting end 34, 44 of the first tube 12 and the second tube 14 engages a respective casing 74 and inner core 82 of a respective bracket means 20, 22. The inner core 82 can remain flush with the height of the casing 74. Alternatively, the inner core 82 may extend above the casing 74 or remain below within the casing 74. The generally hollow mounting end 34, 44 fits a respective inner core 82 inside the respective tube 12, 14 and a respective casing 74 around an outside of the respective tube 12, 14, as shown in FIGS. 1A-1C and 5. Once loaded into the bracket means 20 the respective locking means 76 is activated. The locking means 76 can comprise at least one locking screw 84, which threads through the side of the casing 74 to contact and hold the tube 12, 14 in place relative to the base body 72. The prior art known locking means 76 abuts against each mounting end 34, 44 of the outer tube 12 and the inner tube 14 to hold position and prevent rotation of each mounting end 34, 44.

FIGS. 1B and 2 show the open position of the assembly 10. The attachment end 42 of the inner tube 14 moves within the attachment end 32 of the outer tube 12 to a set length. The locking pin 58 remains engaged to the mobile blocker 56 of the spring chamber 16 so that the compression spring 54 stays in a compressed state. The assembly 10 can be manipulated and moved easily for locating the correct position in a bathtub/shower enclosure. The open position allows easy handling by the user installing the assembly 10.

FIGS. 1C and 3 show the locked and tensioned position of the assembly 10. The inner tube 14 is in a set position relative to the outer tube 12 with spacing to fit in an enclosure. The overlap of the attachment end 32 of the outer tube 12 over the attachment end 42 of the inner tube 14 is set. After the locking pin 58 is released from the mobile blocker 56, the compression spring 54 expands along the length of the outer tube 12 into an extended state. The mobile blocker 56 abuts against the attachment end 42 of the inner tube 14 within the attachment end 32 of the outer tube 12. Because the diameter of the attachment end 42 is smaller than the diameter of the attachment end 32 of the outer tube 12, the mobile blocker 56 can effectively press against the inner tube 14. In the embodiment of FIG. 3, the inner tube 14 further comprises a stop blocker 60 at a tip of the attachment end 42 of the inner tube 14. The mobile blocker 56 abuts against the stop blocker 60 in the attachment end 42 of the inner tube 14 within the attachment end 32 of the outer tube 12. The stop blocker 60 and the smaller diameter of the attachment end 42 of the inner tube 14 both engage the pressure exerted by the mobile blocker 56.

The method of installing a shower rod assembly 10 relates to a bathtub/shower enclosure with three walls and an open side. The assembly 10 is mounted against opposing walls across the open side. Each bracket means 20 is attached to each mounting end 34, 44 of the outer tube 12 and the inner tube 14. The locking pin 58 is engaged to the mobile blocker 56, and the compression spring 54 is in a compressed state. The attachment end 42 of the inner tube 14 is inserted within the attachment end 32 of the outer tube 12 for a set length so as to fit in an enclosure. The variable length must fit within the range of overlap of the outer tube 12 and inner tube 14. The variable length may also be restricted by the position of the spring chamber 16 within the outer tube 12. The variable length may also be curved or linear. Once positioned against the walls of the enclosure, the locking pin 58 is released from the mobile blocker 56. Such that the compression spring 54 is released to expand to an extended state. The compression spring 54 pushes the mobile blocker 56 to engage the attachment end 42 of the inner tube 14 or a stop block 60 or both. The set length of the outer tube 12 and the inner tube 14 is locked by exerting pressure of the compression spring 54 to the outer tube 12 by the fixed blocker 52 and to the inner tube 14 by the mobile blocker 56, and the bracket means 20 of both tubes 12, 14 push the walls of the enclosure. Each bracket means 20 are fixed by each mounting means 34, 44 for a locked position of the assembly 10.

The step of exerting pressure may further comprise the base body 72 pressing against an adhesive, as mounting means 78, in an enclosure. The pressure prevents the base body 72 from pulling away from the wall of the enclosure and reinforces the friction contact of the adhesive. Additionally, twisting and rotational forces on the base body are reduced.

In the embodiments of the present invention, the shower rod assembly has an innovative curvature and adjustable length. The curvature includes arcuate portions and linear portions for controlling the force exerted on the bracket means. Prior art curved rods cannot re-direct compressive force as taught by the present invention. Furthermore, the adjustable length is easy and quick because of the telescoping tubes and the spring chamber. The inner tube slides within the outer tube for easy twisting adjustment to a set length. Once placed, a set and locked position can be achieved with little physical effort, allowing all types of users to install the assembly. Physical strength and prolonged twisting and screwing adjustments are no longer needed. Removal of the locking pin triggers spring action to do the physical work required for stable and secure positioning. Additionally, the compressive force of the spring friction-fits a bracket for attachment to the enclosure, for instance, pressuring adhesive flush against the walls of the enclosure. The brackets further resist twisting and rotation of the tubes in the brackets, so that the curvature is not lowered or tilted. The locking of the tubes within the volume created by the inner core and casing of each bracket resists buckling and downward twisting of the curvature during installation. The assembly, although curved, maintains position across the open side of the enclosure. Installation is made easier because of the quick spring action during installation.

The foregoing disclosure and description of the invention is illustrative and explanatory thereof. Various changes in the details of the illustrated structures, construction and method can be made without departing from the true spirit of the invention.

I claim:

1. A shower rod assembly comprising:

an outer tube, being generally hollow and having a mounting end and an attachment end;

a spring chamber, being housed in said attachment end of said outer tube, said spring chamber comprising:

a fixed blocker in a locked position within said outer tube;

a compression spring, having one end in contact with said fixed blocker; and a mobile blocker with a removable locking pin, being positioned at an opposite end of said compression spring, opposite said fixed blocker;

an inner tube, being generally hollow and having a mounting end and an attachment end, said attachment end of said inner tube having a diameter smaller than said attachment end of said outer tube, said attachment end of said inner tube being insertable within said attachment end of said outer tube; and a bracket means engaging said mounting end of said outer tube for installation and said mounting end of said inner tube for installation, each bracket means being generally identical, wherein said attachment end of said inner tube moves within said attachment end of said outer tube to a set length, said spring chamber having said locking pin engaged in said mobile blocker, said compression spring being in a compressed state, said outer tube, said spring chamber, said inner tube and said bracket means having an open position.

2. The shower rod assembly according to claim 1, wherein said outer tube further comprises a first arcuate portion between said mounting end of said outer tube and said attachment end of said outer tube, said mounting end of said outer tube and said attachment end of said outer tube being linear, and wherein said inner tube further comprises a second arcuate portion between said mounting end of said inner tube and said attachment end of said inner tube, said mounting end of said inner tube and said attachment end of said inner tube being linear.

3. The shower rod assembly according to claim 1, the mounting ends and the attachment ends of a respective outer tube and respective inner tube being aligned and parallel.

4. The shower rod assembly according to claim 1, said first arcuate portion and said second arcuate portion having identical curvature.

5. The shower rod assembly according to claim 1, said bracket means comprising:

a base body with ridges;

a casing with an inner core, being centered on said base body;

a locking means on a side of said casing; and a mounting means for installation on a side of said base body opposite said casing.

6. The shower rod assembly according to claim 5, wherein each mounting end of said outer tube and said inner tube engages a respective casing and inner core of a respective bracket means, each mounting end being generally hollow with a respective inner core fitted inside and a respective casing fitted outside.

7. The shower rod assembly according to claim 6, wherein respective locking means comprises at least one locking screw, said at least one locking screwing abutting each mounting end of said outer tube and said inner tube to hold position and rotation of each mounting end.

8. The shower rod assembly according to claim 5, wherein said mounting means is comprised of an adhesive.

9. The shower rod assembly according to claim 5, wherein said mounting means is comprised of at least one screw hole and a mounting screw.

10. The shower rod assembly according to claim 1, having a locked and tensioned position, wherein said inner tube is in a set position relative to said outer tube with spacing to fit in an enclosure with said attachment end of said outer tube overlapping said attachment end of said inner tube, said locking pin being released from said mobile blocker, said compression spring being in an extended state, said mobile blocker abutting against said attachment end of said inner tube within said attachment end of said outer tube.

11. The shower rod assembly according to claim 1, having a locked and tensioned position, wherein said inner tube further comprises a stop blocker at a tip of said attachment end of said inner tube, and wherein said inner tube is in a set position relative to said outer tube with spacing to fit in an enclosure with said attachment end of said outer tube overlapping said attachment end of said inner tube, said locking pin being released from said mobile block, said compression spring being in an extended state, said mobile blocker abutting against said stop blocker in said attachment end of said inner tube within said attachment end of said outer tube.

12. The shower rod assembly according to claim 1, wherein said fixed blocker is friction fit within said outer tube.

13. The shower rod assembly according to claim 12, wherein said fixed blocker is positioned adjacent said first arcuate portion of said outer tube.

14. A method of covering a shower enclosure having three walls and an open side with a shower curtain, said method comprising the steps of:

installing a shower rod assembly according to claim 1, wherein each bracket means attaches to each mounting end of said outer tube and said inner tube, said locking pin being engaged to said mobile blocker, said compression spring being in a compressed state, wherein said attachment end of said inner tube inserts within said attachment end of said outer tube for a set length so as to fit between opposing walls of said shower enclosure, wherein said locking pin releases from said mobile blocker, said compression spring being in an extended state, said mobile blocker engaging said attachment end of said inner tube to lock said set length of said outer tube and said inner tube, wherein pressure of said compression spring is exerted to said outer tube by said fixed blocker and to said inner tube by said mobile blocker, and wherein each bracket means is fixed by each mounting means for a locked position of said outer tube and said inner tube; and hanging said shower curtain across said open side on said shower rod assembly.

15. The method of covering the shower enclosure according to claim 14, further comprising the step of: adjusting for a set length determined by installation.

16. The method of covering the shower enclosure according to claim 14, wherein said base body presses against an adhesive in said enclosure, said adhesive being said mounting means.

17. A shower rod assembly comprising:

an outer tube, being generally hollow and having a mounting end and an attachment end;

a spring chamber, being housed in said attachment end of said outer tube, said spring chamber comprising:

a fixed blocker in a locked position within said outer tube;

a compression spring, having one end in contact with said fixed blocker; and a mobile blocker with a removable locking pin, being positioned at an opposite end of said compression spring, opposite said fixed blocker;

an inner tube, being generally hollow and having a mounting end and an attachment end, said attachment end of said inner tube having a diameter smaller than said attachment end of said outer tube, said attachment end of said inner tube being insertable within said attachment end of said outer tube; and a bracket means engaging said mounting end of said outer tube for installation and said mounting end of said inner tube for installation, each bracket means being generally identical, wherein each bracket means comprises:

a base body with ridges;

a casing with an inner core, being centered on said base body;

a locking means on a side of said casing; and a mounting means for installation on a side of said base body opposite said casing, said mounting end of said outer tube having a respective bracket means, said mounting end of said inner tube having a respective bracket means, facing opposite the bracket means of said outer tube.

18. The shower rod assembly according to claim 17, wherein said outer tube further comprises a first arcuate portion between said mounting end of said outer tube and said attachment end of said outer tube, said mounting end of said outer tube and said attachment end of said outer tube being linear, and wherein said inner tube further comprises a second arcuate portion between said mounting end of said inner tube and said attachment end of said inner tube, said mounting end of said inner tube and said attachment end of said inner tube being linear, the mounting ends and the attachment ends of a respective outer tube and respective inner tube being aligned and parallel.

19. The shower rod assembly according to claim 17, wherein each mounting end of said outer tube and said inner tube engages a respective casing and inner core of a respective bracket means, each mounting end being generally hollow with a respective inner core fitted inside and a respective casing fitted outside.

* * * * *